US007382180B2

(12) United States Patent
Chen

(10) Patent No.: US 7,382,180 B2
(45) Date of Patent: Jun. 3, 2008

(54) REFERENCE VOLTAGE SOURCE AND CURRENT SOURCE CIRCUITS

(75) Inventor: Yin-Chang Chen, Hsinchu County (TW)

(73) Assignee: eMemory Technology Inc., Hsin-Chu (TW)

( * ) Notice: Subject to any disclaimer, the term of this patent is extended or adjusted under 35 U.S.C. 154(b) by 245 days.

(21) Appl. No.: 11/308,659

(22) Filed: Apr. 19, 2006

(65) Prior Publication Data

US 2007/0247215 A1 Oct. 25, 2007

(51) Int. Cl.
*G05F 1/10* (2006.01)

(52) U.S. Cl. ..... 327/543; 323/316

(58) Field of Classification Search ..... 327/530, 327/538, 540–543

See application file for complete search history.

(56) References Cited

U.S. PATENT DOCUMENTS 6,057,727 A * 5/2000 Dautriche et al. ..... 327/543
6,060,945 A * 5/2000 Tsay ..... 327/543
6,448,750 B1 * 9/2002 Shor et al. ..... 323/282
6,501,303 B1 * 12/2002 Suyama ..... 327/81
6,822,514 B1 11/2004 Aude ..... 330/260
6,847,220 B2 1/2005 Tay et al. ..... 324/755
6,940,337 B2 * 9/2005 Viswanathan et al. ..... 327/541
7,068,094 B1 * 6/2006 Jamal et al. ..... 327/541
7,301,316 B1 * 11/2007 Pham ..... 323/281
2003/0020444 A1 * 1/2003 Kamenicky ..... 323/315
2006/0267568 A1 * 11/2006 Huang ..... 323/316
2007/0164810 A1 * 7/2007 Chen ..... 327/541

* cited by examiner

*Primary Examiner*—N. Drew Richards
*Assistant Examiner*—Thomas J Hiltunen
(74) *Attorney, Agent, or Firm*—Jianq Chyun IP Office

(57) ABSTRACT

The voltage source and current source circuits including an amplifier, a first current mirror circuit, a first PMOS transistor, a second current mirror circuit and a NMOS transistor are provided. The amplifier has a positive input terminal and a negative input terminal coupled to the source terminal of the NMOS transistor. The first current mirror circuit is coupled to a reference current and duplicates the reference current to the source terminal of the first PMOS transistor. The first PMOS transistor has a drain terminal, a gate terminal and a source terminal. The drain terminal of the NMOS transistor is coupled to the third current terminal, and the gate terminal of the NMOS transistor is coupled to the source terminal of the first PMOS transistor. The second current mirror circuit duplicates the current from the third current terminal.

9 Claims, 3 Drawing Sheets

REFERENCE VOLTAGE SOURCE AND CURRENT SOURCE CIRCUITS

BACKGROUND OF THE INVENTION

1. Field of the Invention

The present invention relates to the reference voltage source and current source circuits, and more particularly, to the voltage source and current source circuits using a source follower.

2. Description of the Related Art

Figure 1:
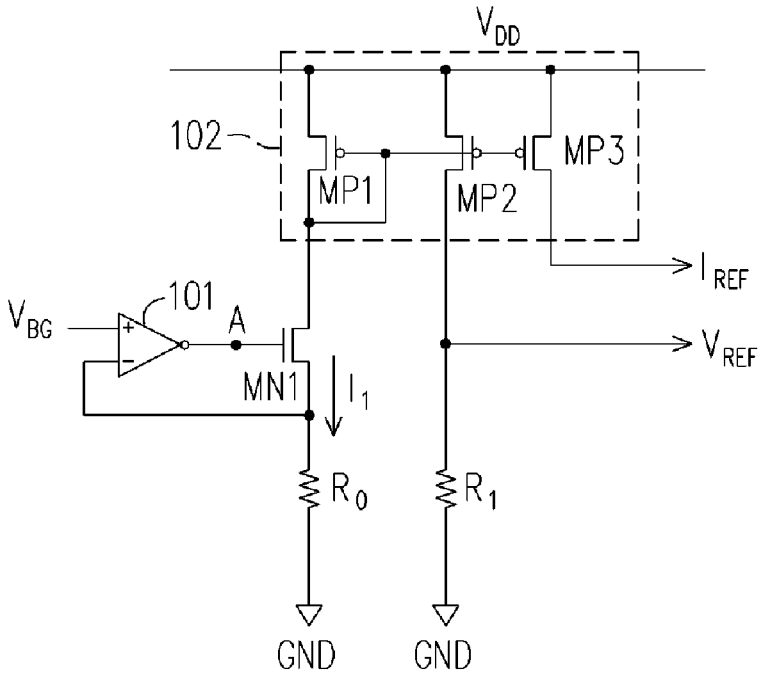
FIG. 1 (PRIOR ART)

The reference voltage source and current source circuits are widely utilized in the analog circuit for providing a DC parameter that has lower correlation to the fabricating process parameter. FIG. 1 schematically shows the conventional voltage source and current source circuits. Referring to FIG. 1, the conventional voltage source and current source circuits comprise an amplifier 101, a current mirror circuit 102, an NMOS transistor MN1, and two resistors $R_0$~$R_1$. Wherein, the negative input terminal of the amplifier 101 is electrically coupled to the source of the transistor MN1 and is grounded through the resistor $R_0$. The current mirror circuit 102 is electrically coupled to the drain of the transistor MN1 and sequentially outputs a reference voltage $V_{REF}$ and a reference current $I_{REF}$.

The current mirror circuit 102 comprises three PMOS transistors MP1~MP3. The sources of the PMOS transistors MP1~MP3 are electrically coupled to a DC bias $V_{DD}$, and the gates of the PMOS transistors MP1~MP3 jointly coupled with each other are electrically coupled to the drain of the PMOS transistor MP1.

Referring to FIG. 1, after the voltage $V_{BG}$ is amplified by the amplifier 101, a voltage signal is generated on the source of the transistor MN1. Meanwhile, the voltage on the node A, i.e. the output voltage of the amplifier 101, can be represented as $V_{BG}+V_{TN}$, where $V_{TN}$ is a threshold voltage of the transistor. For providing high portability to the modern electronic products, the analog circuit is usually operated under a lower DC bias, such that the purpose of lower power consumption is achieved. However, when the conventional voltage source and current source circuits are operated under a lower voltage, the output voltage of the amplifier 101 is easily deviated from the ideal output voltage level. For example, if the DC bias $V_{DD}$ is 2.5V and $V_{BG}+V_T\approx 2.2V$, meanwhile the output voltage of the amplifier 101 is far deviated from the ideal output point $V_{DD}/2$ (1.25V). Accordingly, the signal source of the conventional voltage source and current source circuits are not stable, which further impacts the voltage gain and generate noises.

Moreover, under the low voltage operation, the output voltage of the amplifier 101 may be too close to the DC bias $V_{DD}$, which constraints the selection of the configurations for fulfilling the requirements of the full-swing output voltage.

SUMMARY OF THE INVENTION

Therefore, it is an object of the present invention to provide a voltage source circuit, a current source circuit, and the voltage source and current source circuits that combine two signal sources mentioned above. The circuits provided by the present invention can provide a stable reference voltage source and/or a stable reference current source.

In order to achieve the object mentioned above and other advantages, the present invention provides a voltage source circuit. The voltage source circuit comprises an amplifier, a first current mirror circuit, a second current mirror circuit, a first PMOS transistor and an NMOS transistor. Wherein, the connection ports of the first and second current mirror circuits are the first and second current terminals, and the third and fourth current terminals. The positive input terminal of the amplifier receives an operating voltage, and the negative input terminal of the amplifier is electrically coupled to the source of the NMOS transistor and grounded through a first resistor. The drain of the NMOS transistor is electrically coupled to the third current terminal, and the gate of the NMOS transistor coupled to the second current terminal is electrically coupled to the source of the first PMOS transistor. The drain of the first PMOS transistor is grounded, and the gate of the PMOS transistor is electrically coupled to the output terminal of the amplifier. In addition, a driving current provided to the first current terminal is duplicated to the second current terminal by the first current mirror circuit, such that the driving current is provided to the first PMOS transistor. The current flowing through the third current terminal of the second current mirror circuit is duplicated to the fourth current terminal according to the proportion, and a reference voltage is output by a second resistor that is electrically coupled between the ground and the fourth current terminal.

According to another aspect of the present invention, a current source circuit is provided. The current source circuit comprises an amplifier, a first current mirror circuit, a second current mirror circuit, a first PMOS transistor and an NMOS transistor. Wherein, the connection ports of the first and second current mirror circuits are the first and second current terminals, and the third and fourth current terminals. The positive input terminal of the amplifier receives an operating voltage, and the negative input terminal of the amplifier is electrically coupled to the source of the NMOS transistor and grounded through a first resistor. The drain of the NMOS transistor is electrically coupled to the third current terminal, and the gate of the NMOS transistor coupled to the second current terminal is electrically coupled to the source of the first PMOS transistor. The drain of the first PMOS transistor is grounded, and the gate of the PMOS transistor is electrically coupled to the output terminal of the amplifier. In addition, a driving current provided to the first current terminal is duplicated to the second current terminal by the first current mirror circuit, such that the driving current is provided to the first PMOS transistor. The current flowing through the third current terminal of the second current mirror circuit is duplicated to the fourth current terminal according to the proportion, and a reference current is output from the fourth current terminal.

According to yet another aspect of the present invention, a voltage source and current source circuit is provided. The voltage source and current source circuit comprises an amplifier, a first current mirror circuit, a second current mirror circuit, a first PMOS transistor, and an NMOS transistor. Wherein, the connection ports of the first and second current mirror circuits are the first and second current terminals, and the third, fourth and fifth current terminals. The positive input terminal of the amplifier receives an operating voltage, and the negative input terminal of the amplifier is electrically coupled to the source of the NMOS transistor and grounded through a first resistor. The drain of the NMOS transistor is electrically coupled to the third current terminal, and the gate of the NMOS transistor coupled to the second current terminal is electrically coupled to the source of the first PMOS transistor. The drain of the first PMOS transistor is grounded, and the gate of the PMOS transistor is electrically coupled to the output terminal of the amplifier. In addition, a driving current provided to the first current terminal is duplicated to the second current terminal by the first current mirror circuit, such that the driving current is provided to the first PMOS transistor. The current flowing through the third current terminal of the second current mirror circuit is duplicated to the fourth and fifth current terminals according to the proportion, and a reference voltage is output by a second resistor that is electrically coupled between the ground and the fourth current terminal. In addition, a reference current is directly output from the fifth current terminal.

Since the first PMOS transistor is used in the embodiment of the present invention, which effectively changes the level of the amplifier output voltage, such that the problem of the limitation on the amplifier configuration and the unstable signal source are both resolved and the operating effectiveness of the circuit is further improved.

BRIEF DESCRIPTION DRAWINGS

The accompanying drawings are included to provide a further understanding of the invention, and are incorporated in and constitute a portion of this specification. The drawings illustrate embodiments of the invention, and together with the description, serve to explain the principles of the invention.

FIG. 1 schematically shows a conventional voltage source and current source circuit.

Figure 2:
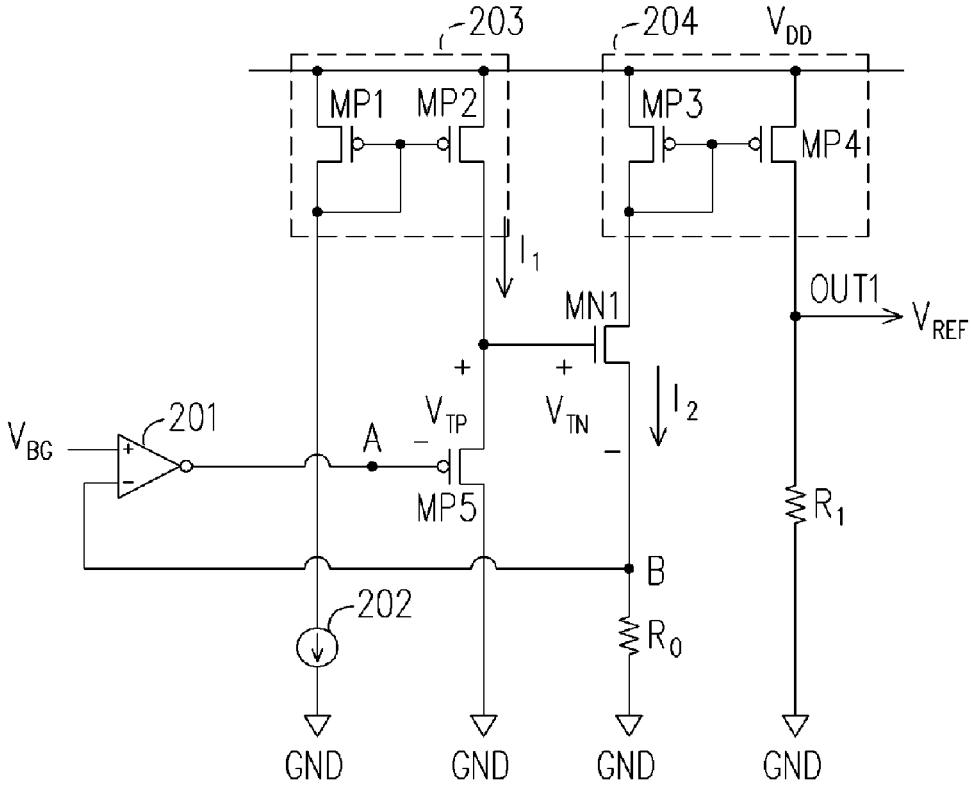

FIG. 2 schematically shows a voltage source circuit according to a preferred embodiment of the present invention.

Figure 3:
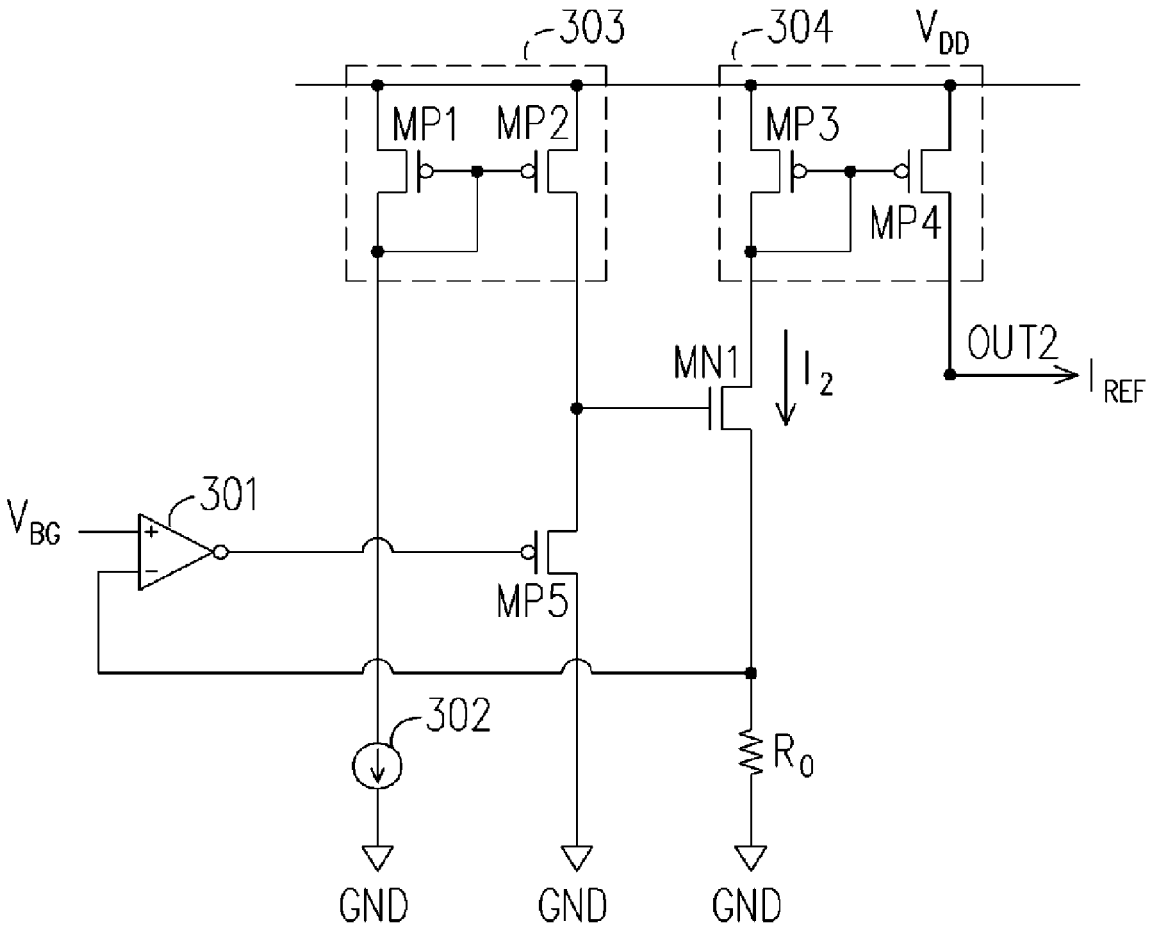

FIG. 3 schematically shows a current source circuit according to a preferred embodiment of the present invention.

Figure 4:
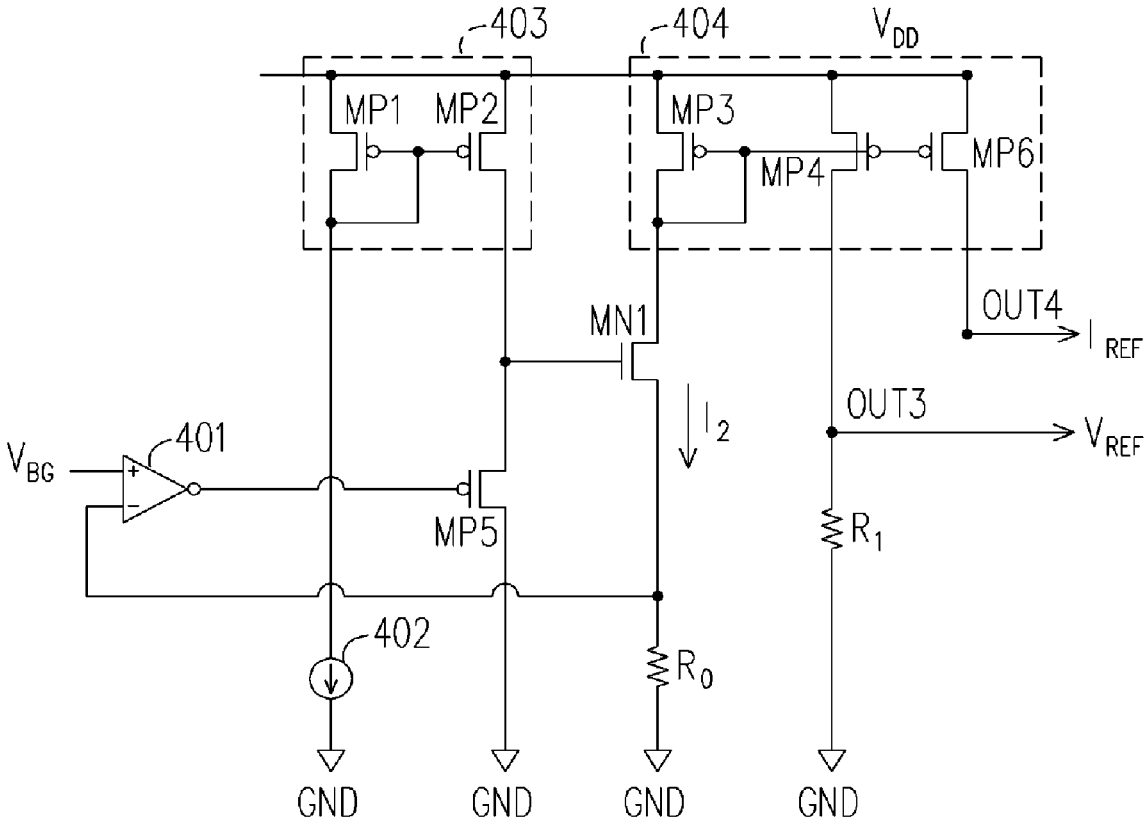

FIG. 4 schematically shows a voltage source and current source circuit according to a preferred embodiment of the present invention.

DESCRIPTION PREFERRED EMBODIMENTS

FIG. 2 schematically shows a voltage source circuit according to a preferred embodiment of the present invention. Referring to FIG. 2, the voltage source circuit comprises an amplifier 201, a driving current 202, two current mirror circuits 203 and 204, two resistors $R_0$~$R_1$, a PMOS transistor MP5, and an NMOS transistor MN1. Wherein, the first current terminal of the current mirror circuit 203 is electrically coupled to the driving current 202. The drain of the PMOS transistor MP5 is grounded, and the source of the PMOS transistor MP5 is electrically coupled to the second current terminal of the current mirror circuit 203. In addition, the gate of the PMOS transistor MP5 is electrically coupled to the output terminal of the amplifier 201 for forming a source follower circuit. Moreover, the drain of the transistor MN1 is electrically coupled to third current terminal of the current mirror circuit 204, and the source of the transistor MN1 is grounded through the resistor $R_1$. Wherein, the third current terminal of the current mirror circuit 204 coupled to the resistor $R_1$ further electrically couples to the reference voltage output terminal OUT1 of the voltage source circuit provided by the present invention.

The current mirror circuit 203 comprises two PMOS transistors MP1 and MP2. Wherein, the sources of the PMOS transistors MP1 and MP2 are jointly coupled to a DC bias $V_{DD}$, and the gates of the PMOS transistors MP1 and MP2 coupled with each other are electrically coupled to the drain of the PMOS transistor MP1, such that a current mirror circuit is formed. The drain of the transistor MP1 is electrically coupled to the first current terminal of the current mirror circuit 203, and the drain of the transistor MP2 is electrically coupled to the second current terminal. With such configuration, the driving current 202 flowing through the first current terminal is duplicated to the current $I_1$ on the second current terminal by the current mirror circuit 203, wherein the current $I_1$ is used by the transistor MP5.

Similarly, the current mirror circuit 204 comprises two PMOS transistors MP3 and MP4. Wherein, the PMOS transistors MP3 and MP4 are connected in the same way as the PMOS transistors MP1 and MP2 except for the drain of the PMOS transistor MP3 is electrically coupled to the third current terminal, and the drain of the PMOS transistor MP4 coupled to the fourth current terminal is electrically coupled to the reference voltage output terminal OUT1 through the fourth current terminal. Similarly, the current $I_2$ flowing through the third current terminal can be duplicated to the resistor $R_1$ that is electrically coupled to the fourth current terminal, and a voltage source $V_{REF}$ is generated by this voltage drop.

Meanwhile, a stable input voltage $V_{BG}$ is generated on this reference circuit, and the voltage is transferred to the node B by the amplifier 201. Therefore, the voltage on the node A is obtained by subtracting the absolute value of the threshold voltage $V_{TP}$ of the transistor MP5 from a summation result of adding the voltage $V_{BG}$ on the node B to the threshold voltage $V_{TN}$ of the transistor MN1. In other words, the voltage on node A is $V_{BG}+V_{TN}-|V_{TP}|$. Accordingly, the voltage drop for the input voltage $V_{BG}$ on the resistor $R_0$ forms a stable current $I_2=V_{BG}/R_0$. Compared to the conventional voltage source and current source circuit, the voltage source circuit provided by the present invention can provide a stable current $I_2$ even when it is operated under a lower DC bias without being impacted by the low operating DC bias as in the conventional circuit. This is because the output voltage of the amplifier 201, i.e. the voltage on the node A had been compensated by the voltage drop $|V_{TP}|$ provided by the transistor MP5, such that the output voltage of the amplifier 201 is still operated on a point near to the ideal operation point of the amplifier output curve. Furthermore, the current $I_2$ is duplicated to the resistor $R_1$ that is electrically coupled to the fourth current terminal by the current mirror circuit 204 formed by the transistors MP3 and MP4, such that a stable reference voltage source $V_{REF}$ is formed, and a reference voltage is output from the reference voltage output terminal OUT1.

FIG. 3 schematically shows a current source circuit according to a preferred embodiment of the present invention. The current source circuit comprises an operational amplifier 301, a driving current 302, two current mirror circuits 303~304, a resistor $R_0$, a PMOS transistor MP5, and an NMOS transistor MN1. The configuration and the operating principle of the current source circuit of FIG. 3 are similar to the voltage source circuit of FIG. 2 except for the table current $I_2$ generated by the current mirror circuit 304 is directly output from the fourth current terminal of the current mirror circuit 304 and provided to the reference current output terminal OUT2 as the system stable reference current $I_{REF}$.

The current mirror circuit 303 comprises two PMOS transistors MP1 and MP2, and the connection and configuration of the PMOS transistors MP1 and MP2 are similar to the current mirror circuit 203 of FIG. 2. In addition, the current mirror circuit 304 comprises two PMOS transistors MP3 and MP4, and the connection and configuration of the PMOS transistors MP3 and MP4 are also similar to the current mirror circuit 204 of FIG. 2 except for the drain of the PMOS transistor MP4 is electrically coupled to the reference current output terminal OUT2 through the fourth current terminal.

It is to be noted that both of the current source circuit of FIG. 3 and the voltage source circuit of FIG. 2 use the transistor MP5 of the source follower configuration to shift the level of the amplifier output voltage, such that the current source circuit of the present embodiment is not impacted by the low DC bias $V_{DD}$.

FIG. 4 schematically shows a voltage source and current source circuit according to a preferred embodiment of the present invention. The voltage source and current source circuit comprises an operational amplifier 401, a driving current 402, two current mirror circuits 403~404, two resistors $R_0$~$R_1$, a PMOS transistor MP5, and an NMOS transistor MN1. The present embodiment combines both embodiments mentioned above. The configuration and the operating principle of the present embodiment are similar to the two embodiments described with reference to FIGS. 2 and 3. The transistor MP5 of the source follower configuration is used to shift the level of the amplifier output voltage, such that the circuit of the present embodiment is not impacted by the low DC bias $V_{DD}$. In the present embodiment, the fourth current terminal of the current mirror circuit 404 provides a stable current $I_2$, and a stable reference voltage $V_{REF}$ is generated and output from the reference voltage output terminal OUT3 when the stable current $I_2$ is flowing through the resistor $R_1$.

Furthermore, the fifth current terminal of the current mirror circuit 404 provides a reference current $I_{REF}$ that is duplicated from the stable current $I_2$, and the reference current $I_{REF}$ is then output from the reference current output terminal OUT4. With such configuration, the circuit of the present embodiment can provide the reference voltage source and the reference current source required by the system, and maintains the stability of the signal sources even when it is operated under a lower DC bias.

In summary, since a transistor of a source follower configuration is used in the embodiments of the present invention, which effectively changes the level of the amplifier output voltage, such that the problem of the limitation on the amplifier configuration and the unstable signal source when the conventional voltage source and current source circuit is operated under a lower voltage are both resolved and the operating effectiveness of the circuit is further improved.

Although the invention has been described with reference to a particular embodiment thereof, it will be apparent to one of the ordinary skills in the art that modifications to the described embodiment may be made without departing from the spirit of the invention. Accordingly, the scope of the invention will be defined by the attached claims not by the above detailed description.

What is claimed is:

1. A voltage source circuit having a reference voltage output terminal, comprising:

an amplifier having a positive input terminal, a negative input terminal, and an output terminal, wherein the positive input terminal receives an operating voltage;

a first current mirror circuit having a first current terminal and a second current terminal, wherein the first current terminal is electrically coupled to a driving current for duplicating the driving current to the second current terminal;

a first PMOS transistor having a drain that is grounded, a gate is electrically coupled to the output terminal of the amplifier, and a source is electrically coupled to the second current terminal of the first current mirror circuit;

an NMOS transistor having a source that is grounded through a first resistor and electrically coupled to the negative input terminal of the amplifier, and a gate is electrically coupled to the second current terminal; and a second current mirror circuit having a third current terminal and a fourth current terminal, in which a current flowing through the third current terminal is duplicated to the fourth current terminal, wherein the third current terminal is electrically coupled to the drain of the NMOS transistor, and the fourth current terminal is grounded through a second resistor and electrically coupled to the reference voltage output terminal.

2. The voltage source circuit of claim 1, wherein the first current mirror circuit comprises:

a second PMOS transistor having a source is electrically coupled to a DC bias, and having a gate and a drain that are jointly coupled and electrically coupled to the first current terminal; and a third PMOS transistor having a source is electrically coupled to the DC bias, a gate is electrically coupled to the gate of the second PMOS transistor, and a drain is electrically coupled to the source of the first PMOS transistor.

3. The voltage source circuit of claim 1, wherein the second current mirror circuit comprises:

a fourth PMOS transistor having a source is electrically coupled to a DC bias, and having a gate and a drain are electrically coupled to the drain of the NMOS transistor; and a fifth PMOS transistor having a source is electrically coupled to the DC bias, a gate is electrically coupled to the gate of the fourth PMOS transistor, and a drain is electrically coupled to the reference voltage output terminal through the fourth current terminal.

4. A current source circuit having a reference current output terminal, comprising:

an amplifier having a positive input terminal, a negative input terminal and an output terminal, wherein the positive input terminal receives an operating voltage;

a first current mirror circuit having a first current terminal and a second current terminal, wherein the first current terminal is electrically coupled to a driving current for duplicating the driving current to the second current terminal;

a first PMOS transistor having a drain that is grounded, a gate is electrically coupled to the output terminal of the amplifier, and a source is electrically coupled to the second current terminal of the first current mirror circuit;

an NMOS transistor having a source that is grounded through a resistor and electrically coupled to the negative input terminal of the amplifier, and a gate is electrically coupled to the second current terminal; and a second current mirror circuit having a third current terminal and a fourth current terminal, in which a current flowing through the third current terminal is duplicated to the fourth current terminal, wherein the third current terminal is electrically coupled to the drain of the NMOS transistor, and the fourth current terminal is electrically coupled to the reference current output terminal.

5. The current source circuit of claim 4, wherein the first current mirror circuit comprises:

a second PMOS transistor having a source is electrically coupled to a DC bias, and having a gate and a drain are electrically coupled to the first current terminal; and a third PMOS transistor having a source is electrically coupled to the DC bias, a gate is electrically coupled to the gate of the second PMOS transistor, and a drain is electrically coupled to the source of the first PMOS transistor.

6. The current source circuit of claim 4, wherein the second current mirror circuit comprises:

a fourth PMOS transistor having a source is electrically coupled to a DC bias, and having a gate and a drain are electrically coupled to the drain of the NMOS transistor; and a fifth PMOS transistor having a source is electrically coupled to the DC bias, a gate is electrically coupled to the gate of the fourth PMOS transistor, and a drain is electrically coupled to the reference current output terminal through the fourth current terminal.

7. A voltage source and current source circuit having a reference voltage output terminal and a reference current output terminal, comprising:

an amplifier having a positive input terminal, a negative input terminal, and an output terminal, wherein the positive input terminal receives an operating voltage;

a first current mirror circuit having a first current terminal and a second current terminal, wherein the first current terminal is electrically coupled to a driving current for duplicating a driving current to the second current terminal;

a first PMOS transistor having a drain that is grounded, a gate is electrically coupled to the output terminal of the amplifier, and a source is electrically coupled to the second current terminal of the first current mirror circuit;

an NMOS transistor having a source is grounded through a first resistor and electrically coupled to the negative input terminal of the amplifier, and a gate is electrically coupled to the second current terminal; and a second current mirror circuit having a third current terminal, a fourth current terminal, and a fifth current terminal, in which a current flowing through the third current terminal is duplicated to the fourth current terminal and the fifth current terminal, wherein the third current terminal is electrically coupled to the drain of the NMOS transistor, the fourth current terminal is grounded through a second resistor and electrically coupled to the reference voltage output terminal, and the fifth current terminal is electrically coupled to the reference current output terminal.

8. The voltage source and current source circuit of claim 7, wherein the first current mirror circuit comprises:

a second PMOS transistor having a source is electrically coupled to a DC bias, and having a gate and a drain are electrically coupled to the first current terminal; and a third PMOS transistor having a source is electrically coupled to the DC bias, a gate is electrically coupled to the gate of the second PMOS transistor, and a drain is electrically coupled to the source of the first PMOS transistor.

9. The voltage source and current source circuit of claim 7, wherein the second current mirror circuit comprises:

a fourth PMOS transistor having a source is electrically coupled to a DC bias, and having a gate and a drain are electrically coupled to the drain of the NMOS transistor;

a fifth PMOS transistor having a source is electrically coupled to the DC bias, a gate is electrically coupled to the gate of the fourth PMOS transistor, and a drain is electrically coupled to the reference voltage output terminal through the fourth current terminal; and a sixth PMOS transistor having a source electrically coupled to the DC bias, a gate is electrically coupled to the gate of the fourth PMOS transistor, and a drain is electrically coupled to the reference current output terminal through the fifth current terminal.

* * * * *